US005096723A

United States Patent [19]

Turpin

[11] Patent Number: 5,096,723

[45] Date of Patent: Mar. 17, 1992

[54] MICROWAVE FOOD HEATING PACKAGE WITH SERVING TRAY

[75] Inventor: Charles H. Turpin, Minneapolis, Minn.

[73] Assignee: Golden Valley Microwave Foods Inc., Edina, Minn.

[21] Appl. No.: 557,146

[22] Filed: Jul. 23, 1990

[51] Int. Cl.[5] ..... B65D 85/00

[52] U.S. Cl. ..... 426/107; 219/10.55 E; 426/113; 426/124; 426/234; 426/243

[58] Field of Search ..... 426/107, 113, 234, 243, 426/126, 124; 219/10.55 E; 229/23 BT, 23 R, 901, 902, 903, 904

[56] References Cited

U.S. PATENT DOCUMENTS

| | | | |
|---|---|---|---|
| 2,917,218 | 12/1959 | Guyer | 229/23 |
| 3,027,062 | 3/1962 | Huss | 229/23 |
| 3,353,968 | 11/1967 | Krajewski | 99/192 |
| 3,483,358 | 12/1969 | Eisler | 219/385 |
| 3,946,187 | 3/1976 | MacMaster | 219/10.55 E |
| 4,081,646 | 3/1978 | Goltsos | 219/10.55 E |
| 4,121,510 | 10/1978 | Frederick | 99/425 |
| 4,190,757 | 2/1980 | Turpin | 219/10.55 E |
| 4,230,924 | 10/1980 | Brastad | 219/10.55 E |
| 4,267,420 | 5/1981 | Brastad | 219/10.55 E |
| 4,365,739 | 12/1982 | Webinger | 229/23 BT |
| 4,398,077 | 8/1983 | Freedman et al. | 219/10.55 E |
| 4,470,538 | 9/1984 | Heathecck | 229/23 R |
| 4,474,324 | 10/1984 | Forbes, Jr. | 229/23 BT |
| 4,555,605 | 11/1985 | Brown | 219/10.55 E |
| 4,567,341 | 1/1986 | Brown | 426/107 |
| 4,588,081 | 5/1986 | Newsome et al. | 229/23 BT |
| 4,590,349 | 5/1986 | Brown | 219/10.55 E |
| 4,594,492 | 6/1986 | Maroszek | 219/10.55 E |
| 4,626,641 | 12/1986 | Brown | 219/10.55 E |
| 4,641,005 | 2/1987 | Sieferth | 219/10.55 E |
| 4,777,053 | 10/1988 | Tobelmann | 426/107 |
| 4,794,005 | 12/1988 | Swiontek | 426/107 |
| 4,806,718 | 2/1989 | Seaborne et al. | 426/107 |
| 4,870,233 | 9/1989 | McDonald | 219/10.55 E |
| 4,933,526 | 6/1990 | Fisher | 219/10.55 M |
| 4,935,592 | 6/1990 | Oppenheimer | 219/10.55 E |
| 4,943,439 | 7/1990 | Andreas et al. | 426/107 |

*Primary Examiner*—Donald Czaja
*Assistant Examiner*—Anthony Weier
*Attorney, Agent, or Firm*—James V. Harmon

[57] ABSTRACT

A food heating and serving package for elongated food products or food sticks such as french fries, fish sticks, waffle sticks and the like is described which includes an inner sleeve portion and an outer tray portion telescopically mounted over the sleeve. The sleeve includes a plurality of parallel partitions formed from microwave energy-absorbing susceptor material positioned in parallel relationship to define a honeycomb-like array of cells adapted to receive the food sticks for the purpose of crisping, toasting or browning the surface of the food sticks. The tray includes a broad panel defining a base with four low side panels extending upwardly therefrom to define an open wide mouth. One of the low side panels of the tray covers an open end of the sleeve so that when the sleeve is lifted out of the tray, the food sticks can easily slide through the open end of the sleeve into the open wide mouth of the tray which is of sufficient size to hold other food products such as salt or a condiment and to act as a serving dish from which the food can be directly eaten.

9 Claims, 4 Drawing Sheets

MICROWAVE FOOD HEATING PACKAGE WITH SERVING TRAY

FIELD OF THE INVENTION

The present invention relates to packages for heating foods in a microwave oven.

BACKGROUND OF THE INVENTION

A variety of microwave susceptor-containing packages have been previously proposed for absorbing microwave energy and transmitting it by conduction to crisp and brown the surface of the food product. Some prior susceptors were stiff, brittle, subject to breakage or otherwise unsuited for use in lightweight, disposable and low cost packaging. In other cases the susceptor, while interacting with the microwave energy present in an oven, does not adequately heat or crisp the food product. Other susceptors heat only one side of the food product. So, for example, if the food product is rectangular in shape, two or three sides remain pale and uncrispened. The susceptor itself shold be easy to insert into the package and, once inserted, should be retained securely in place.

U.S. Pat. Nos. 4,612,431 and 4,735,513 describe a susceptor formed from polyester film to which a thin, semicondcutive layer of metal is applied. Tests conducted in the development of the present invention show, however, that these laminates and the resulting packages are not effective in crisping, browning or toasting the surface of a food such as a french fried potato. After heating, the product still tends to be perceived as somewhat moist, limp and soggy. To overcome these problems, a package was developed which is much more effective in crisping the surface of stick-shaped food pieces. Different forms of this package are described in U.S. Pat. Nos. 4,943,439 and 5,034,234. These designs provide a microwave susceptor package that will crisp, toast or brown several surfaces of a stick-shaped food product such as french fried potatoes, fish sticks or the like so that the food is perceived to be crisp and appetizing to the consumer. They do, however, have certain shortcomings. The food is difficult to cool, i.e. hot moisture vapor tends to remain trapped inside, the food receiving tray is small, tends to tip over, has no room for condiments and is expensive to manufacture.

In view of these shortcomings of the prior art, it is a major objective of the invention to provide an improved microwave food heating package which includes a serving tray and in which much more efficient cooling of the package can be accomplished. A further objective is to provide a package of the type described having a serving tray of substantial width and length with a broad base and a wide mouth into which the hot food sticks can be easily poured from the inner portion of the carton. Another object is to provide an improved package of the type described having a wide serving tray with a low profile to provide room for other food ingredients such as condiments, salt and the like and which is less expensive to manufacture than the serving tray described in U.S. Pat. No. 5,034,234.

SUMMARY OF THE INVENTION

The present invention provides a food package containing a microwave interactive susceptor which is self-supporting and contains a self-supporting honeycomb-like arrangement of heating compartments, each partially or completely enclosing a food product. Each of many food pieces is preferably enclosed within one of the compartments so that susceptor material is adjacent to two or more sides of each piece. It is most preferred that the susceptor material enclose the food piece on at least three sides. For example, a finished heating package can contain self-supporting, open-ended compartments having parallel walls or partitions spaced apart from one another and extending along the length of the package in parallel relationship. This provides a plurality of elongated openings between the partitions, each receiving one food piece. In one form of the invention the package includes a stack of several partitioned susceptors formed from microwave interactive laminated sheet material.

Thus, the invention includes at least one and preferably a stack of folded susceptor sheets to provide a heating susceptor surface on at least three sides of each food piece. The package includes a carton which preferably has a separate inner sleeve portion and an outer tray portion that slides onto and encloses one major face and four sides of the sleeve. The sleeve portion contains the heating susceptors. Opposed locking tabs on the sleeve engage the susceptors along opposite edges and interact with the susceptors to hold them in place with a wedging action.

Vent openings are provided to allow a cooling air flow over the food product prior to assembly with the tray and also provide venting of steam during microwave cooking. After heating, the sleeve portion of the carton is removed and the food products are slid out of the compartments into the tray portion of the carton which then functions as a serving dish from which the food can be directly eaten.

The invention will now be described by way of example with reference to the accompanying figures which illustrate but a few of the various ways in which the present invention can be practiced within the scope of the appended claims.

THE FIGURES

DESCRIPTION OF A PREFERRED EMBODIMENT

Figure 1:
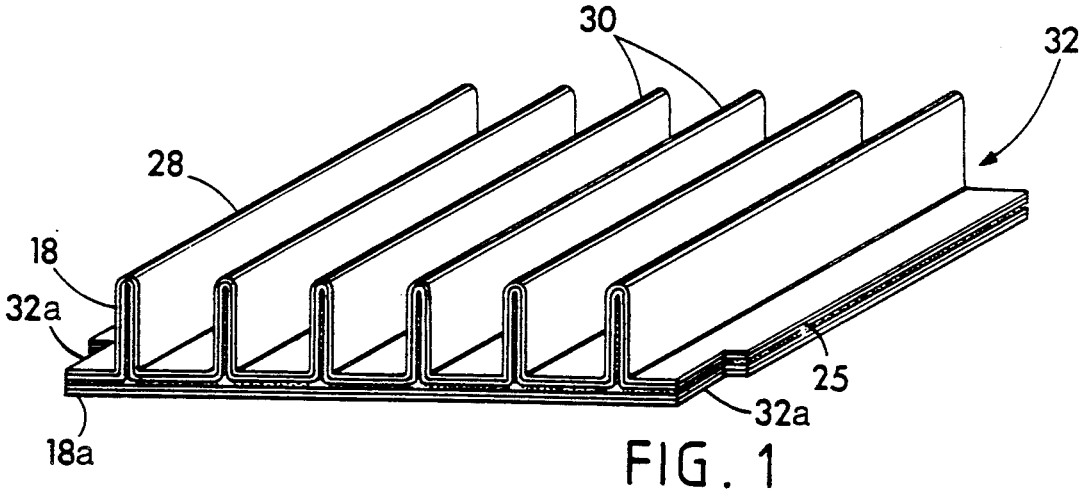
FIG. 1 is an enlarged, semi-diagrammatic perspective view showing one form of food heating susceptor in accordance with the invention.

FIGS. 1–4 show microwave heating susceptors 32, each composed of a laminated sheet 18 in accordance with the present invention. Each susceptor 32 is composed of three separate sheets laminated together and including an inner sheet of paper 20 facing the food, an outer sheet of paper 22 and a sheet of flexible plastic 24 such as polyester film which serves as a backing for a microwave interactive coating 26, e.g. a semiconductive metallic coating 26 formed from aluminum or other metal deposited by vacuum metallization and transmitting about 40% to 60% of incident light. The metal can be coated on a base sheet comprising a 2 mil polyester film 24. The metal coating 26 is semiconductive so that it will interact with the microwave energy in a microwave oven to absorb a portion of the microwave energy, converting it to heat. Other known coatings or substances that will become hot in a microwave oven can be used in place of the metal coating if desired. A backing layer 18*a* consists of paper with a heat seal coating which is applied to hold pleats 28 in the position shown in FIGS. 1, 3 and 4. Layer 22 can be eliminated from sheet 18 if desired for some applications. In that event, the susceptor 32 will consist of a single sheet 18 composed of a layer of paper 20, glue 25 and a microwave reactive layer (sheet 24 and coating 26).

Figure 2:
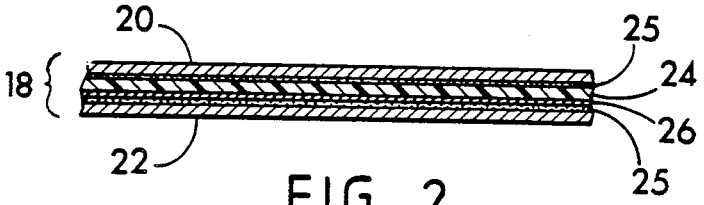
FIG. 2 is a microscopic cross-sectional view of the susceptor of FIG. 1.

The laminate 18 is folded into a plurality of vertically extending flutes or pleats in which the sheet is folded against itself. The various sheets, e.g. flutes or pleats 28, of each of the laminates 18 or 18*a* can be bonded together with adhesive such as a polyvinylacetate emulsion type adhesive 25 (FIG. 2). The upper and lower sheets 18 and 18*a* can be bonded together with the same adhesive 25. While a variety of paper sheets can be used, sheet 20 can comprise 25-pound greaseproof paper and sheet 22 can comprise 30-pound kraft paper. The laminate 18*a* can be constructed of a paper similar to sheet 22, coated on one side with an adhesive similar to adhesive 25.

Figure 3:
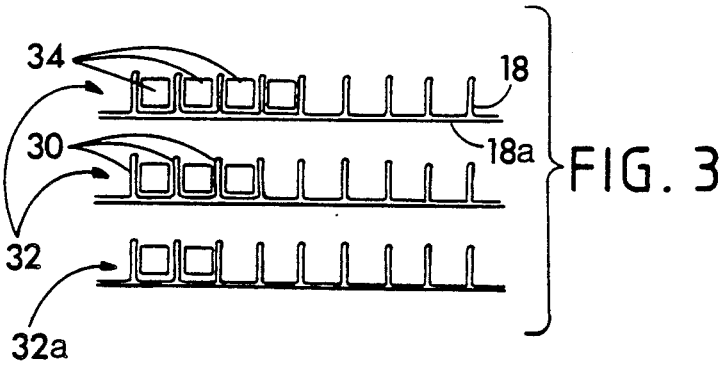
FIG. 3 is an exploded end view of a stack of susceptors in accordance with the invention.
Figure 4:
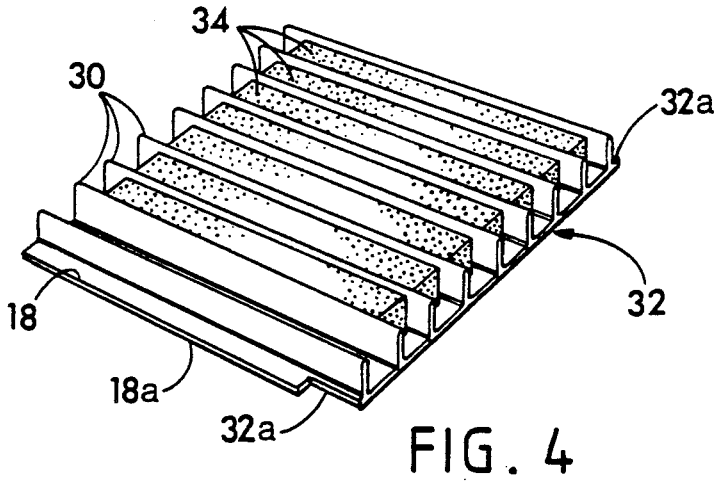
FIG. 4 is a perspective view of one form of susceptor containing food sticks in accordance with the invention.

In FIG. 3 is shown a stack of laminated susceptors 32 formed from bonded laminates 18 and 18*a* in which are placed food pieces such as french fry sticks or fish sticks 34, each within one of the enclosures between the partitions 30. It will thus be seen that with the stack assembled as shown in FIG. 3 at least three major surfaces of the food pieces 34 are exposed to one of the microwave interactive susceptor sheets 18 and all such surfaces will therefore be browned, toasted or crisped during the heating process. If desired, a package can contain only a single susceptor 32 as shown in FIG. 4. The susceptor 32 must touch or almost touch the surface of the food to achieve a crisping or toasting effect. This makes otherwise unappealing french fries or fish sticks appetizing. The invention can be used with a variety of other vegetables and meat based foods such as bread sticks, carrot sticks, soft pretzels, batter coated vegetables such as tempura, as well as corn dogs or other dough wrapped meat products.

Figure 5:
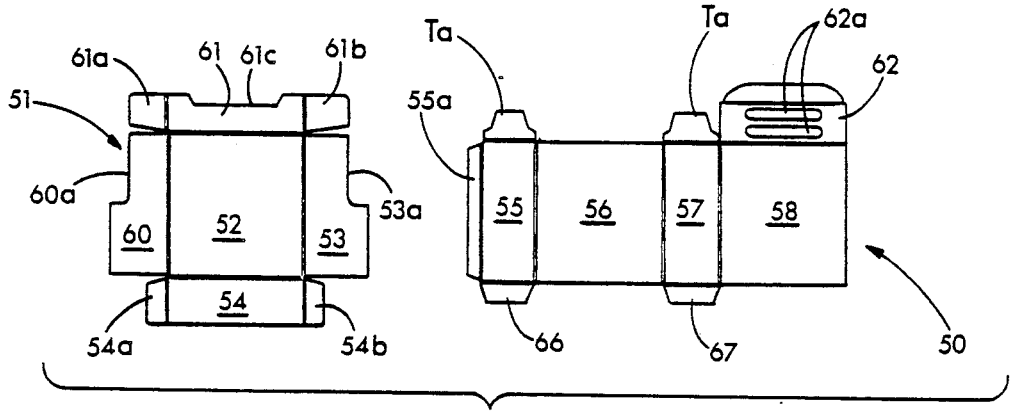
FIG. 5 shows a plan view of one form of two carton blanks that can be employed together to provide a carton of the invention.
Figure 6:
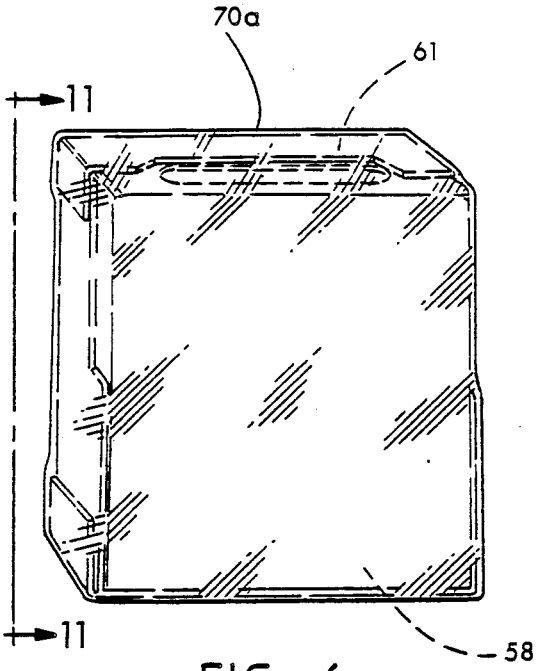
FIG. 6 is a perspective view of the carton prior to being opened.
Figure 7:
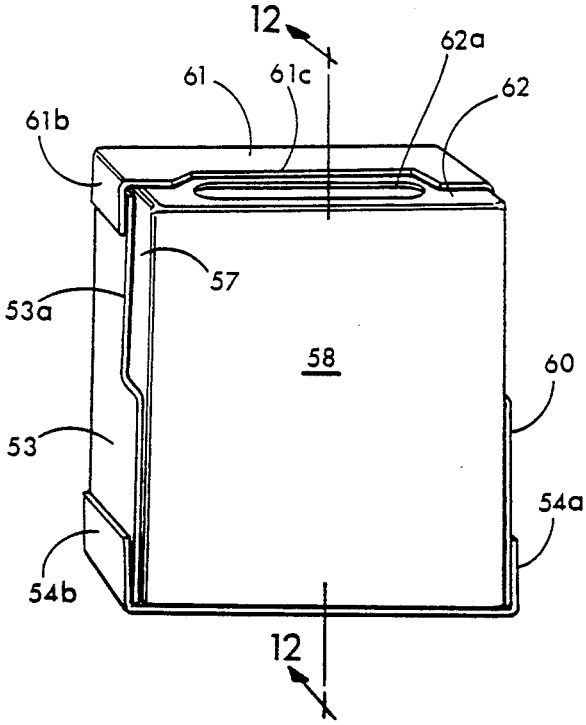
FIG. 7 is a persective view of the carton as it appears during heating in a microwave oven with the overwrap removed.

Refer now to FIGS. 5–13 which illustrate one form of folding carton that can be employed in connection with the invention. As shown in FIG. 5, two carton blanks 50 and 51 are provided. Blank 51 is an outer tray portion and blank 50 is an inner sleeve portion. The blanks are formed from food grade paperboard. The tray 51 has a wide bottom wall 52, low side panels which fold upwardly to form the side walls of the tray, and end panels 54, 61 which form the end of the tray. Tabs 54*a*, 54*b*, 61*a* and 61*b* hold the tray together by being bonded to adjacent panels, e.g. by adhesive or by locking means well known in the trade.

Figure 13:
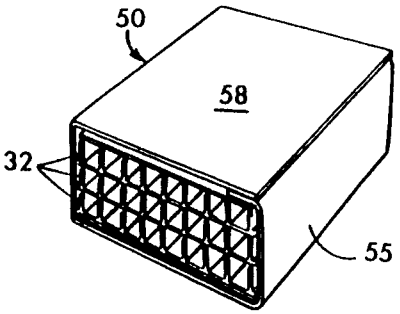
FIG. 13 is a perspective view of the inner sleeve portion of the package after the tray is removed.

The tray portion 51 includes low side panels 53 and 60, each provided with a cut-out area or notch 53*a*, 60*a*. Low end panels 54 and 61 include bonding tabs 54*a*, 54*b* and 61*a*, 61*b*. The end tab 61 also includes a cutaway portion or notch 61*c* for exposing a vent opening as will be described. The inner sleeve portion 50 of the package is composed of two opposing major face panels 56 and 58 and a pair of narrow side walls 55 and 57 separated by parallel fold lines. An edge tab 55*a* is bonded to panel 58 to form the portion 50 into a sleeve. End tabs are designated Ta and a folding cover flap 62 is provided with two parallel laterally extending spaced apart vent slots 62*a*. The opposite end of sleeve 50 is open to expose the susceptors 32 as shown in FIG. 13. On opposite edges of the sleeve 50 are two retaining tabs 66 and 67.

Figure 8:
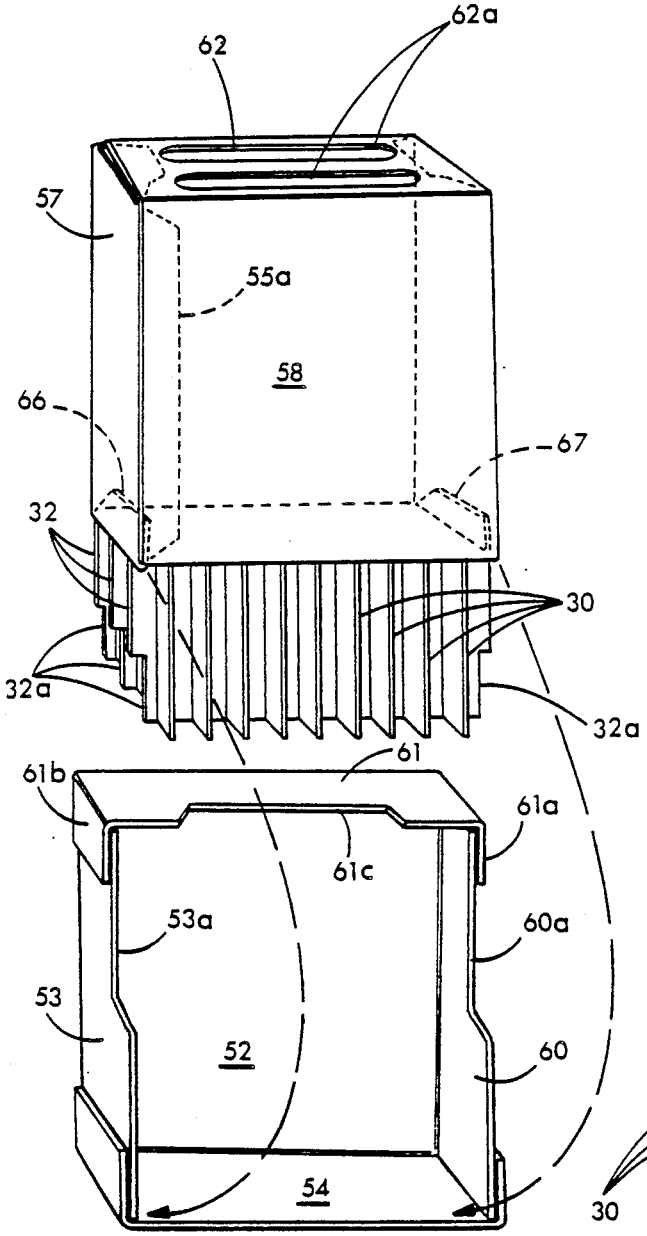
FIG. 8 is a perspective exploded view of the carton.
Figure 9:
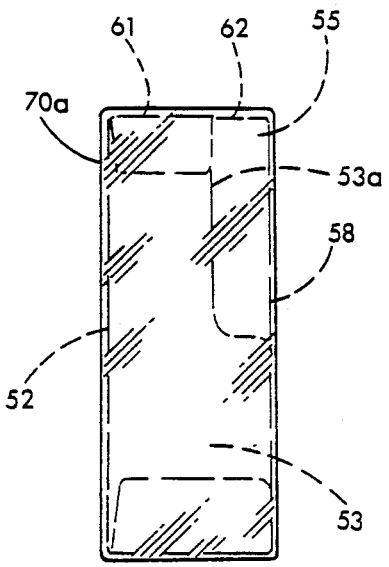
FIG. 9 is a side view taken on line 9—9 of FIG. 6.
Figure 10:
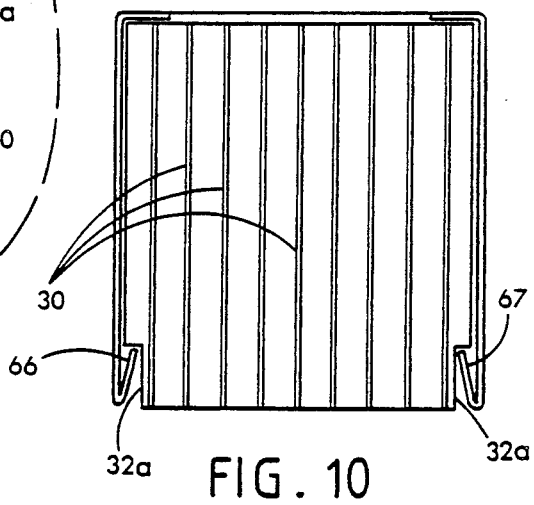
FIG. 10 is a vertical cross-sectional view of the package taken on line 10—10 of FIG. 7.
Figure 11:
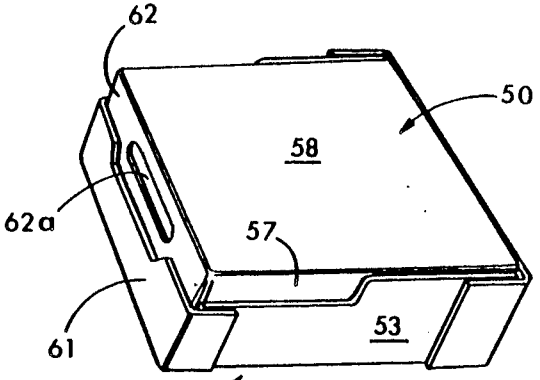
FIG. 11 is a perspective view of the package.

The stack of susceptors 32 of FIGS. 1–4 are inserted into sleeve 50 from either end, either before or after the french fries, fish sticks or other food pieces 34 are placed in the susceptors 32. In a preferred filling method, the susceptors 32 are first individually filled by placing the food sticks into the compartments between the partitions 30 as shown in FIG. 4. Susceptors are then stacked one on top of the other and inserted into the carton. The tabs Ta are folded down and cover flap 62 is tuck-locked in place. The filled sleeve 50 is then placed in the outer tray 51 as shown in FIGS. 8, 10 and 11. The food pieces 34 may be hot when placed in the sleeve 50. Hot moisture vapor tends to cause the carton to become soft and limp. If so, to cool the food pieces 34, a cooling gas is preferably blown through the sleeve 50, e.g. by passing ambient air and later chilled air through vent slots 62*a* and through the open end of the sleeve visible in FIG. 13. Cooling in this way before wrapping with film 70*a* causes the sleeve 50 to hold its shape better and improves the quality of the food. Chilling can be accomplished in several zones, with the final zone chilling the food to less than 45° F. and preferably, for french fried potatoes, to about 0° F. or below. Finally, the assembled carton is overwrapped with protective barrier film 70*a* such as polypropylene or saran coated cellophane and sealed. The filled carton is now ready for shipment.

One especially effective method of holding the susceptors 32 in the carton are the opposed, centrally folded, upwardly directed susceptor-retaining tabs 66 and 67 at the end of panels 55 and 57. The tabs 66 and 67 are folded upwardly so as to project up into aligned recesses 32*a* provided on opposite edges of each of the susceptors 32. Since tabs 66 and 67 are directed upwardly, they cooperate with each other through their engagement with the susceptors 32 to provide a wedging action for holding the susceptors in place in the upper portion 50 of the carton. In this way the susceptors 32 will be securely held in place by the retaining tabs 66 and 67, allowing the food product to be freely shaken from the sleeve 50 while retaining the susceptors 32 in place.

The carton thus comprises inner and outer telescoping portions 50 and 51. The tray portion 51 as shown in FIGS. 8–12 includes a wide or broad base (panel 52) and four low side walls 53, 54, 60 and 61 which form a shallow tray with low side walls defining a wide mouth.

Figure 12:
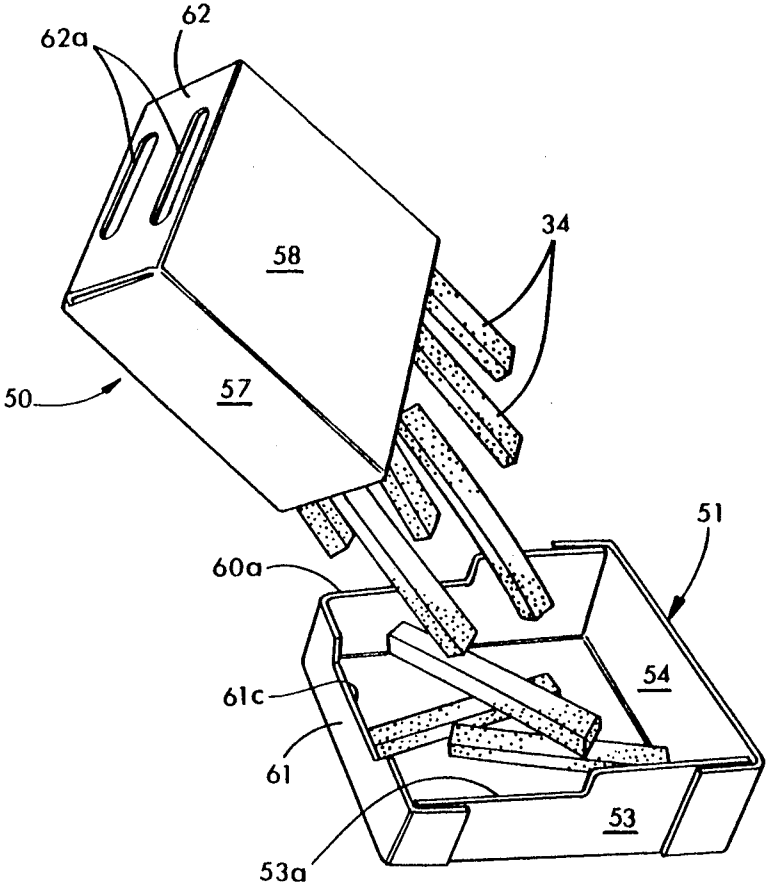
FIG. 12 is a perspective view of a food product being poured from the inner sleeve portion of the package into the serving tray portion.

The wide open mouth of the tray provides an opening as wide as a major face 56 of sleeve 50, enabling food pieces 34 to be easily poured into the tray (FIG. 12). The cutaway areas or notches 53*a*, 60*a* enable the sleeve 50 to be easily lifted out of the tray 51 after heating in a microwave oven.

The sleeve portion 50 of the carton is raised as shown in FIG. 12 to expose the food sticks 34 which then fall or are easily poured into the tray 51 (FIG. 12). It can therefore be seen that drawing apart the upper and lower portions 50, 51 of the carton separates the microwave interactive susceptors 32 from the food product 34 which remains in place and, as it does so, slides endwise out of the openings in the susceptors and falls into the tray portion 51 of the carton where they can then either be eaten directly or, if desired, placed in a serving bowl or dish. In any event, the open wide mouth, low side walls and broad base wall 52 of the tray 51 enable a condiment or salt to be placed in the tray 51.

It should be noted that the compartments for the rectangular food sticks 34 in the trays 32 have a square corners and that the bottom is flat rather than round as in corrugated board or other corrugated partitioning packages. In this way the food product 34 is surrounded and in contact or nearly in contact, preferably on at least three sides, with the microwave interactive material of the susceptor 32 in which it rests and on the fourth side by the susceptor 18*a* of the sheet above it so that there is a uniform clearance on all major, i.e. elongated, surfaces of the food piece. The food pieces contact or almost contact the compartment walls but each is slidably and removably held in its compartment. The clearance is typically about 1/64 to 1/32 inches or less. During heating in the microwave oven, the partitions 30 will pick up microwave energy, convert said energy to heat and transfer the heat directly to the surfaces of the food pieces which in the course of heating will be crisped as they are toasted. The vent slots 62*a* also facilitate the escape of excess steam during microwave heating. In this way the food pieces 34 are toasted, browned and crisped effectively on at least three and preferably on all four sides.

While the invention is suited for a variety of different kinds of food pieces, it is particularly well suited for use with fabricated food products such as fabricated french fried potatoes prepared from a moist, cooked and mashed potato mass, i.e. potato dough which is molded to rectangular shape shown, cut into pieces of the required length, fried in hot shortenening and then placed in the package. The vent slots 62*a* cooperate with the opposite end of the carton to enable french fries to be quickly cooled by passing air straight through the chambers in which they are held as air is forced through the sleeve.

Many variations of the present invention within the scope of the appended claims will be apparent to those skilled in the art once the principles described above are understood.

What is claimed is:

1. A microwave heating and serving package for food sticks, comprising:

a carton that is at least partially transparent to microwave energy to enable the microwave energy to enter the package for heating the food, said carton being composed of two separable carton portions including a sleeve portion having a pair of broad opposing top and bottom walls, a pair of opposing side walls on opposite sides thereof and a first end having an end wall extending at right angles to the top, bottom and side walls, said end wall having a vent opening therein of sufficient size to permit gas and vapor to pass out of the sleeve portion;

said sleeve portion being open at a second end thereof opposite to said first end, food sticks movably supported in the sleeve portion in such a manner as to allow the food sticks to slide through the open end of the sleeve portion;

the other portion of said carton comprising a tray portion including a wide bottom panel to serve as a base, four low side wall panels to provide a wide mouth for the tray corresponding in shape to the top and bottom walls of the sleeve portion, the tray being telescopically mounted over the sleeve portion with one side wall panel of the tray substantially closing the open end of the sleeve portion sufficiently to prevent the food sticks from sliding out of the sleeve portion and the tray being open at the top leaving the top wall of the sleeve portion uncovered, another of said side wall panels, disposed opposite to said one side wall panel having a) a cutaway portion defining a notch, b) said notch having a free edge that is sufficiently low that the side wall panel does not overlap the vent opening, c) the vent opening is thereby exposed at all times to permit the escape of moisture vapor during heating even with the tray telescopically mounted upon the sleeve portion, at least one microwave heating susceptor within the sleeve portion for heating the food sticks to crisp or brown the surface thereof said susceptor including open-ended channel means extending between the ends of the sleeve portion to permit air to pass from one end of the sleeve portion to the other past the food sticks contained in the channels, whereby when the sleeve portion is lifted out of the tray portion the food sticks are free to slide out of the open end of the sleeve portion and fall into the tray portion through the open wide mouth of the tray portion.

2. The package of claim 1 wherein the food comprises french fried potato sticks, a plurality of said susceptors are placed in a stack one above the other within said sleeve, and one of the low side wall panels of the tray closes the open end of the sleeve to prevent the french fried potatoes from falling out of the open end of the sleeve prior to removal of the tray from the sleeve.

3. The package of claim 1 wherein the vent opening comprises at least one elongated transversely extending vent slot in said end wall and the vent slot cooperates with the open end of the sleeve to permit a cooling gas to flow through the sleeve from one end thereof to the other for chilling the food sticks.

4. The package of claim 3 wherein the end will of the sleeve includes a pair of said vent openings, said vent openings comprising parallel laterally extending spaced apart slots in the wall, a plurality of said susceptors are provided in stacked relationship within the sleeve and the slots are aligned generally in parallel relationship with the stack of susceptors for directing the flow of cooling air across the food sticks contained between the susceptors to help remove moisture vapor from the package and chill the food.

5. The microwave heating and serving package of claim 3 wherein said wall with said cutaway portion defining the notch covers one of a pair of similar vent slots and exposes a second one of said similar slots to permit the passage of gas or vapor through one slot and not the other.

6. A microwave heating and serving package for food sticks comprising, a carton that is at least partially transparent to microwave energy to enable the microwave energy to enter the package for heating the food sticks, said carton comprising two separable carton portions including an inner sleeve portion having a pair of broad opposing front and rear walls, a pair of opposing side walls on opposite sides thereof and top and bottom ends, one of said top end and said bottom end having a vent means defined therethrough and the other end being open, at least one microwave heating susceptor element within the sleeve portion for interacting with microwave energy to produce heat for heating the food sticks to crisp or brown the surface thereof, a quantity of food sticks within the sleeve portion positioned adjacent to the heating susceptor element, said sticks being substantially aligned between the top and bottom ends of the sleeve portion and being exposed through said open end, the other portion of the carton comprising a tray including a wide rear panel and four low sidewall panels projecting forwardly therefrom to provide a wide mouth for the tray corresponding in shape to the front and rear walls of the sleeve portion and said tray being telescopically mounted to the sleeve portion with the wide rear panel against the rear wall of the sleeve portion and one of the four low sidewall panels of the tray substantially closing the open end of the sleeve portion and a second of said sidewall panels of the tray opposite said one sidewall panel being constructed and arranged to expose the vent means at the one end of the sleeve portion to allow moisture vapor generated during microwave heating to escape through the vent means, said second sidewall panel being characterized by a) a cutaway portion, b) said cutaway portion having a free edge that is sufficiently low that the sidewall panel does not overlap the vent means, and c) the vent means is thereby exposed at all times to permit the escape of moisture vapor during heating even with the tray telescopically mounted to the sleeve portion, whereby when the sleeve portion is removed from the tray the food sticks are free to slide out of the open end of the sleeve portion and to enter the tray through the open wide mouth of the tray which tray can then function as a serving dish from which the hot food sticks can be directly eaten.

7. The package of claim 6 wherein at least some of the other low sidewall panels of the tray have cutaway portions defining notches to expose portions of the sleeve for enabling the user to grasp the sleeve to facilitate removing it from the tray.

8. A microwave heating and serving package for food sticks comprising, a carton that is at least partially transparent to microwave energy to enable the microwave energy to enter the package for heating the food sticks, said carton comprising two separable carton portions including an inner sleeve portion having a pair of broad opposing face panels, a pair of relatively narrow opposing side walls on opposite sides thereof and first and second opposing ends, a vent passage defined through the first end thereof and an opening defined through the second end, at least one microwave heating susceptor element within the sleeve portion for interacting with microwave energy to produce heat for heating the food sticks to crisp or brown the surface thereof, a quantify of food sticks within the sleeve portion positioned adjacent to the heating susceptor element therein, said sticks being substantially aligned between the vent passage and the opening of the sleeve portion and being exposed through said opening, the other portion of the carton comprising a tray including a wide face panel of substantially the same size as the face panels of the sleeve portion to serve as a base and four low, upright sidewall panels providing a wide mouth for the tray, said mouth corresponding in shape to the broad face panels of the sleeve portion and said tray being further characterized by having:

a) a telescopic sliding fit onto the sleeve portion along an axis substantially perpendicular to the broad face panels of the sleeve portion to maintain one face panel of the sleeve portion exposed when the tray is telescopically mounted on the sleeve portion;

b) the tray being open at the top so that the wide mouth of the tray provides a relatively large opening to facilitate transfer of the food from the sleeve portion into the tray;

c) one of the four low sidewalls of the tray substantially closing the opening in the second end of the sleeve portion; and d) said tray being constructed and arranged to expose enough of the sleeve portion to facilitate manual removal of the sleeve portion from the tray;

e) whereby when the sleeve portion is lifted manually from the tray, the food sticks are free to fall out of the second end of the sleeve portion and to enter the wide mouth of the tray which can then function as a serving dish from which the hot food sticks can be directly eaten.

9. The microwave food heating and service package of claim 8 wherein the heating susceptor element comprises a tray formed by folding said heating susceptor element into a plurality of parallel, upright flutes that are pressed as by pinching the heating susceptor element into narrow folds defining said flutes, said flutes being spaced apart from one another and extending parallel to one another, each of the flutes comprising a double thickness of said heating susceptor element to provide a fluted tray in which compartments are defined by the spaces between the flutes and each food stick is deposited in one of the compartments and is surrounded on three sides by said heating susceptor element.

* * * * *